US006766601B2

(12) United States Patent
Dickins

(10) Patent No.: US 6,766,601 B2
(45) Date of Patent: Jul. 27, 2004

(54) TRENCHING MACHINE

(75) Inventor: Harvey Philip Dickins, Albury (AU)

(73) Assignee: Dickins McLeod Development Pty. Ltd., Albury (AU)

( * ) Notice: Subject to any disclaimer, the term of this patent is extended or adjusted under 35 U.S.C. 154(b) by 142 days.

(21) Appl. No.: 10/085,330

(22) Filed: Feb. 28, 2002

(65) Prior Publication Data

US 2002/0133984 A1 Sep. 26, 2002

(30) Foreign Application Priority Data

Feb. 28, 2001 (AU) ..... PR3436

(51) Int. Cl.[7] ..... E02F 3/08
(52) U.S. Cl. ..... 37/363
(58) Field of Search ..... 37/352, 353, 354, 37/349, 361, 362, 363, 142.5, 403; 172/40, 42, 107, 273; 405/180, 181, 267

(56) References Cited

U.S. PATENT DOCUMENTS 2,835,055 A * 5/1958 Hermes ..... 37/363
2,990,631 A * 7/1961 Brown ..... 37/363
4,483,084 A * 11/1984 Caldwell et al. ..... 37/349
4,750,280 A * 6/1988 Dalaine ..... 37/352
5,562,166 A * 10/1996 Griffin ..... 172/42
5,813,151 A * 9/1998 Stephens et al. ..... 37/352

FOREIGN PATENT DOCUMENTS

AU 601830 B1 3/1987

* cited by examiner

*Primary Examiner*—Robert E Pezzuto
(74) *Attorney, Agent, or Firm*—Buchalter, Nemer, Fields and Younger

(57) ABSTRACT

A trenching machine comprising a wheeled frame and a first motor mounted on the frame is provided. The first motor drives a digging chain carried on a chain guide extending from the machine. The chain guide is pivotally mounted coaxially with a drive chain drive sprocket. An actuating arm for pivotally moving the chain guide relative to the frame, a lock to lock the chain guide in a desired pivotal position, and a second motor mounted on the frame, are also provided. The second motor drives at least one of the machine wheels for moving the machine along the ground. The second motor is releasably engaged to at least one of the machine wheels.

17 Claims, 5 Drawing Sheets

FIG 5
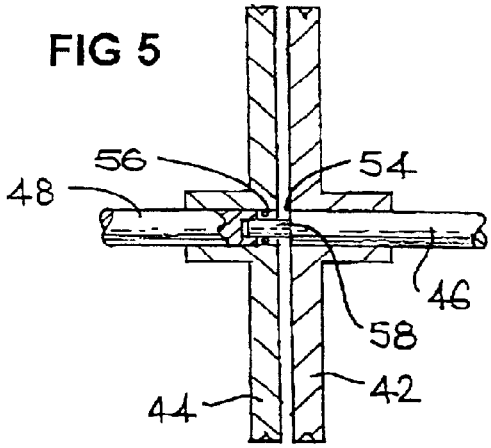
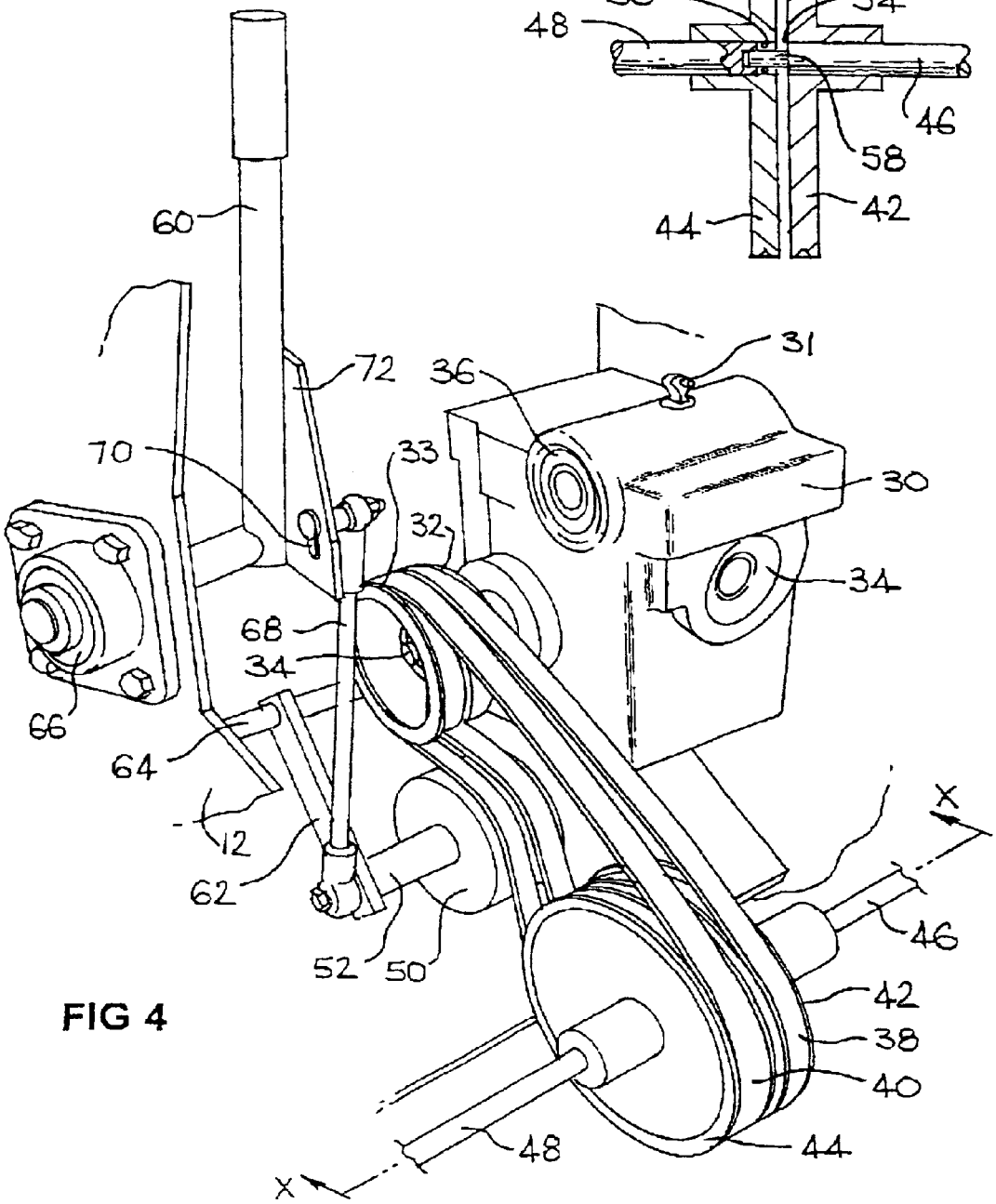
FIG 4

TRENCHING MACHINE

FIELD OF THE INVENTION

The present invention relates to trenching machines and, more particularly, to hand-operated trenching machines. It is to be appreciated, however, that the invention is not limited thereto.

BACKGROUND OF THE INVENTION

Trenching machines of the form addressed by the present invention are designed primarily for digging trenches in the ground. Applications for such trenches include the installation of pipes, drains, cables, and the like. Such trenches are typically relatively shallow.

Difficulties exist in removing the digging implement of existing trenching machines, which are generally in the form of chain-mounted digging teeth.

Moreover, the manoeuvrability of existing trenching machines has generally been found to be less than desirable, particularly when used for applications requiring relatively tight cornering of the machine.

Furthermore, existing machines generally undesirably experience a temporary reduction in power delivered to the digging implement when raising and lowering the chain guide carrying the digging implement. This is because raising and lowering the chain guide in existing machines generally requires power to be drawn from the motor driving the machine's digging implement.

OBJECTS OF THE INVENTION

It is an object of the present invention to address at least one of the above mentioned deficiencies of existing trenching machines.

SUMMARY OF THE INVENTION

One aspect of the present invention is directed to addressing the problem of manoeuvrability of existing trenching machines.

According to one aspect of the present invention there is provided a trenching machine including:

a wheeled frame, a first motor means on the frame, the first motor means driving a digging chain carried on a chain guide extending from the machine, the chain guide being pivotally mounted coaxially with a drive chain drive sprocket, means for pivotally moving the chain guide relative to the frame, locking means to lock the chain guide in a desired pivotal position, and a second motor means on the frame, the second motor means driving at least one of the machine wheels for moving the machine along the ground, wherein the second motor means is releasably engaged to the at least one of the machine wheels.

In a preferred embodiment of the invention, the frame is mounted on four wheels to support the machine for movement along the ground. However, it is to be appreciated that the frame could be mounted on any number of wheels.

It is to be appreciated that the second motor means could drive any number of the frame wheels. In this respect, the second motor means could be arranged to drive only one of the frame wheels. Alternatively, the second motor means could be arranged to drive each of the frame wheels.

In one particularly preferred form the second motor means drives at least two of the frame wheels.

Preferably the at least two frame wheels are arranged in a substantially coaxial manner on the frame.

Preferably, the at least two substantially coaxially arranged wheels (hereinafter referred to as drive wheels) are independently rotatable when the second motor means is disengaged from the drive wheels; and are rotated in unison when the second motor means is engaged with the drive wheels.

In one preferred form there is provided at least two coaxial drive pulleys, and corresponding coaxial driven pulleys, with a belt extending around each respective drive pulley/driven pulley combination. The drive pulleys are connected to a common shaft, which is rotated by the second motor means. The driven pulleys are connected to separately rotatable coaxial shafts, which drive respective drive wheels.

When sufficient tension is maintained in the belts and the second motor means is activated, the second motor means drives the drive pulleys, causing the driven pulleys to rotate in unison. Rotation of the driven pulleys, in turn, causes the drive wheels to rotate in unison to move the machine. When it is desired to change the machine direction, the belts are loosened to the point where the driven pulleys are able to rotate independently of the drive pulleys and therefore also independently of one another. This enables the drive wheels to be rotated independently of one another, thereby enabling the user to manoeuvre the machine as desired.

Preferably the belts are adjustably tensioned via an adjustable tension pulley or pulleys.

In a preferred form, the tension pulley(s) are caused to tension the belts via a hand-operated lever.

The invention has so far been described as including a first motor means and a second motor means. It is to be appreciated, however, that the first motor means and the second motor means could be the same motor means. That is, the same motor means could be used for driving the digging chain carried on a chain guide extending from the machine, and for driving the at least one machine wheel for moving the machine along the ground.

Also, it is to be appreciated that the frame wheels could be replaced by, or used in conjunction with, any other suitable form including caterpillar-type endless track assembly arrangements, if desired.

Preferably, the machine includes handles at one end for guiding movement of the machine along the ground.

A further aspect of the present invention is directed to addressing the difficulties in removing and fitting the digging implement of existing trenching machines.

According to another aspect of the present invention, there is provided a trenching machine including:

a wheeled frame, a first motor means on the frame, the first motor means driving a digging chain carried on a chain guide extending from the machine, the chain guide being pivotally mounted coaxially with a drive chain drive sprocket, means for pivotally moving the chain guide relative to the frame, locking means to lock the chain guide in a desired pivotal position, and a second motor means on the frame, the second motor means driving at least one of the machine wheels for moving the machine along the ground, wherein the chain guide is releasably securable in a position relative to the drive chain sprocket enabling fitting and removal of the digging chain from the machine.

In a preferred form, the chain guide is longitudinally slidably mounted on a boom, with the boom being pivotally mounted to the frame coaxially with the drive sprocket. In this configuration the chain guide is slidable along the boom from a position where the digging chain is taut about the drive sprocket and chain guide, to a position where the digging chain is loosely fitted around the drive sprocket and chain guide.

In one form, apertures are provided in the chain guide and boom. The apertures are aligned when the chain guide is moved longitudinally along the boom to a point where the digging chain is loosened sufficiently to allow fitting and removal of the digging chain. A securing pin can then be releasably inserted through the aligned holes to enable fitting and/or removal of the digging chain from the machine to be undertaken.

According to another aspect of the present invention there, is provided a combination of a boom for pivotally mounting to a trenching machine, and a chain guide slidably mounted on the boom, wherein the chain guide is releasably securable to the boom in a position enabling fitting and removal of a digging chain about the chain guide.

In a preferred form, a biasing spring is provided to bias the chain guide away from the drive sprocket to thereby tension the digging chain about the drive sprocket and chain guide.

Preferably, a mechanism is provided for moving the chain guide against the force of the biasing spring, to enable the chain guide to be releasably secured to the boom in a position enabling fitting and removal of the digging chain. In one form, the mechanism includes a levering arm which, when actuated by the operator, moves the chain guide along the boom against the biasing action of the biasing spring.

A further aspect of the present invention is directed to addressing the temporary reduction in power delivered to the digging implement of existing trenching machines when raising and lowering the boom carrying the digging implement.

According to another aspect of the present invention, there is provided a trenching machine including:

a wheeled frame, a first motor means on the frame, the first motor means driving a digging chain carried on a chain guide extending from the machine, the chain guide being pivotally mounted coaxially with a drive chain drive sprocket, means for pivotally moving the chain guide relative to the frame, locking means to lock the chain guide in a desired pivotal position, and a second motor means on the frame, the second motor means driving at least one of the machine wheels for moving the machine along the ground, wherein the means for pivotally moving the chain guide relative to the frame includes an actuating arm.

Most preferably, the actuating arm is pivotally connected between the frame and at least one of the chain guide, or a boom upon which the chain guide is slidably mounted.

In a particularly preferred form, the actuating arm includes a longitudinally movable screw threaded shaft which meshes with a rotatably mounted helical or bevel gear. Preferably, the helical or bevel gear is rotatably mounted within a housing.

The actuating arm has been described as including a screw threaded shaft and mating helical or bevel gear. However, it is to be appreciated that the actuating arm could adopt any suitable form, including that of a hydraulic ram, screw threaded shaft and mating trunnion, or other appropriate form.

In a particularly preferred form, the actuating arm includes a motor means for rotating the helical or bevel gear to longitudinally move the screw threaded shaft.

Preferably, the actuating arm motor means is in the form of an electric motor connected to an electric power source. However, it is to be appreciated that the motor means could adopt any suitable form. Indeed, it is to be appreciated that the actuating arm motor means could be actuated by the first motor means provided for driving the digging chain and/or the second motor means for moving the machine along the ground.

In a preferred embodiment, the electric power source is in the form of an electric battery mounted on the machine.

In a preferred form, the actuating arm is capable of pivotally moving the chain guide relative to the frame to at least three distinct positions. The first of these positions provides the digging chain in a digging position, with the distal end of the chain digging the ground below ground level. The second position provides the chain guide in a digging commencement position, such that the digging chain rests upon the surface of the ground. The third position provides the chain guide in a non-digging position, wherein the digging chain is clear of the ground surface.

In a preferred form, the operator activates the actuating arm by an electrically operated switch.

The present invention has so far been described in terms of a number of aspects. It is to be appreciated that a trenching machine according to the present invention could include any one or more of the above-defined aspects of the invention.

It will now be convenient to hereinafter describe the invention in greater detail by reference to the accompanying drawings, which show one embodiment of the invention. The particularity of the drawings and the associated description is not to be understood as superseding the generality of the preceding broad description of the invention.

BRIEF DESCRIPTION OF THE DRAWINGS

In the drawings:

FIG. 4 is a perspective view of the drive wheel engagement mechanism of the trenching machine of FIG. 1 when in the disengaged position.

FIG. 5 is a cross-sectional view of the coaxial drive wheel shafts along line X—X in FIG. 4.

DESCRIPTION OF A PREFERRED EMBODIMENT

Figure 1:
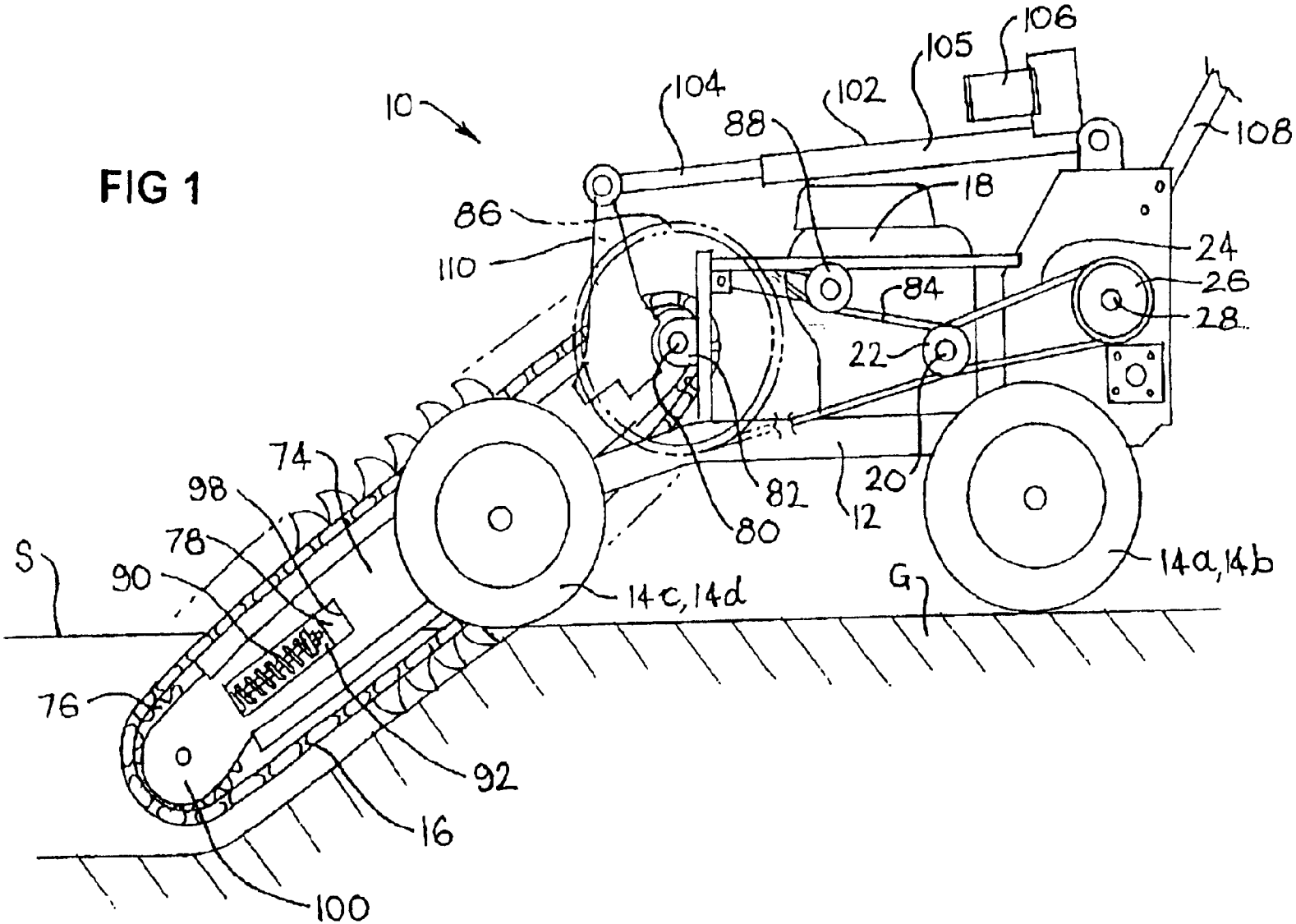
FIG. 1 is a side partial cross-sectional view of a trenching machine according to the present invention, with the digging chain in a trench digging position.

A trenching machine 10 is illustrated in the drawings. The trenching machine 10 includes a frame 12, which includes wheels 14*a,b,c,d.* In the embodiment illustrated, a first motor means for driving a digging chain 16, and a second motor means for driving at least one of the wheels 14*a,b,c,d,* are integrated into the form of a petrol engine 18. The engine 18 is mounted on the frame 12.

The engine 18 includes an output shaft 20. An output pulley 22 is mounted on one end of the output shaft 20. A belt 24 extends around the output pulley 22 and around a gearbox input pulley 26. The pulley 26 is mounted on one end of a gearbox input shaft 28 of a gearbox 30.

The gearbox 30 includes a lubricating oil inlet port 31 and bearing assemblies 34 and 36. The internal workings of the gearbox 30 are not further described.

Gearbox output pulleys 32,33 are connected to one end of a gearbox output shaft 34. It is to be appreciated that rotation of the gearbox input pulley 26 causes the gearbox output pulleys 32,33 to rotate.

Two belts 38 and 40 extend around the gearbox output pulleys 32,33, and around respective wheel shaft pulleys 42 and 44. The wheel shaft pulleys 42 and 44 are mounted to the adjacent ends of coaxial wheel shafts 46 and 48.

A double-groove tension pulley 50 is provided for tensioning the belts 38 and 40. The tension pulley 50 is rotatably mounted on a shaft 52. The tension pulley 50 can be actuated from a substantially non-tensioning position, as illustrated in FIG. 4, to a tensioning position, as illustrated in FIG. 3.

Figure 3:
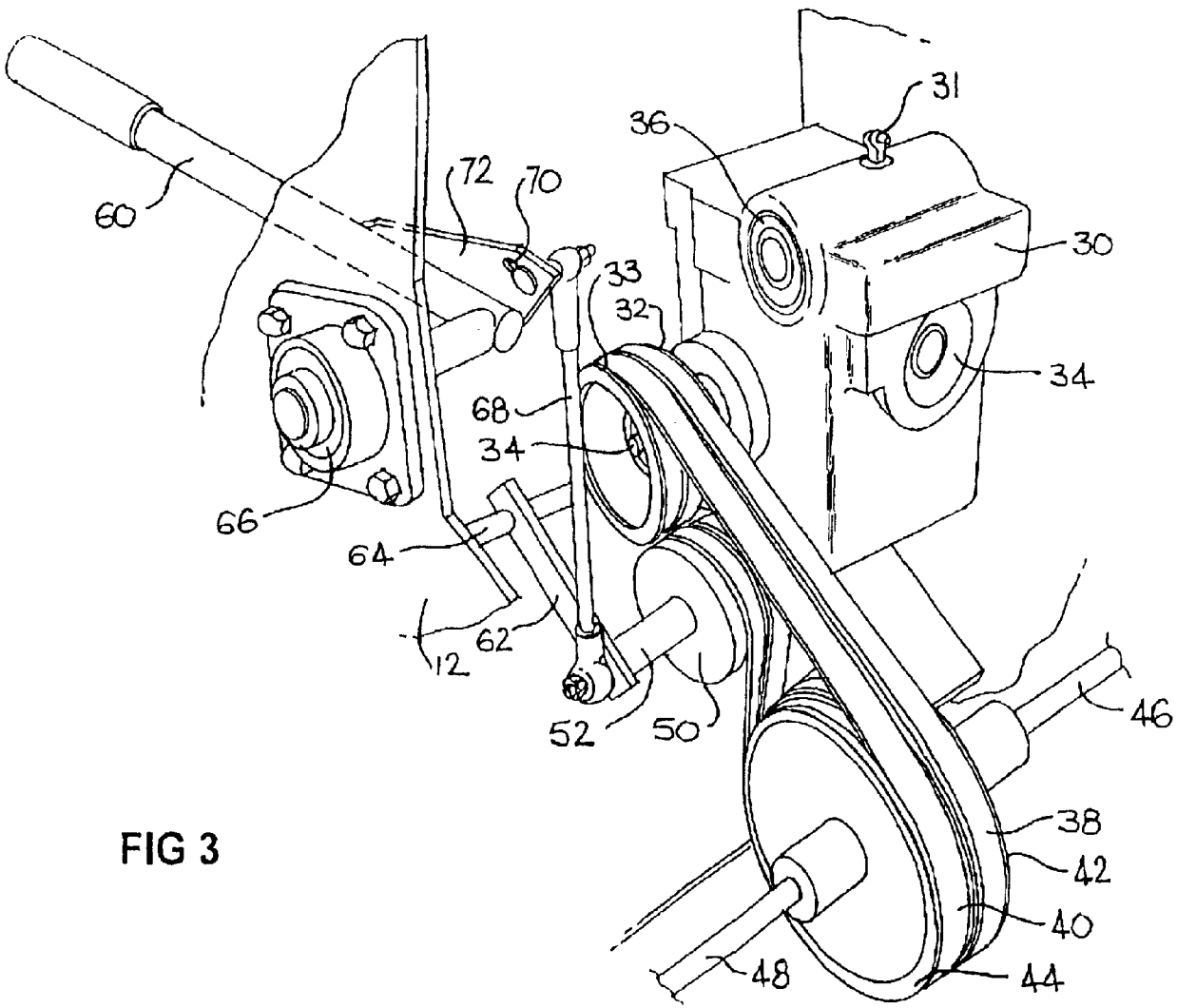
FIG. 3 is a perspective view of the drive wheel engagement mechanism of the trenching machine of FIG. 1 when in the engaged position.

When the tension pulley 50 is in the tensioning position illustrated in FIG. 3, operation of the engine 18 causes the motor output shaft 20 to rotate which, in turn, causes the gearbox input shaft 28 and output shaft 34 to rotate. This causes the gearbox output pulleys 32,33 to rotate. The tensioned belts 38 and 40 cause the wheel shaft pulleys 42 and 44 to rotate in unison, causing the wheel shafts 46 and 48 to rotate in unison. Rotation of the wheel shafts 46 and 48 causes the drive wheels 14*a,b* to also rotate in unison, thereby causing the trenching machine 10 to move over the surface of the ground G.

In some circumstances it is desirable to disengage the drive wheels 14*a,b* from the drive mechanism, such as when the operator wishes to manoeuvre the machine 10. In such circumstances the tension pulley 50 is moved to the non-tensioning position, as illustrated in FIG. 4. In this arrangement the belts 38 and 40 are sufficiently loosely fitted around the gearbox output pulleys 32,33 and the wheel shaft pulleys 42 and 44, such that they slip upon rotation of the pulleys 32,33. The drive wheels 14*a,b* are thereby disengaged from the engine 18. Since the drive wheels 14*a,b* are mounted on independently rotatable shafts, they can rotate independently of one another, thereby allowing the operator to manoeuvre the trenching machine 10 as desired.

FIG. 5 illustrates the arrangement of the wheel shaft pulleys 42,44 and wheel shafts 46,48. As illustrated, the shafts 46 and 48 are substantially coaxial. When the belts 38,40 are in the non-tensioned arrangement (see FIG. 4), the shafts 46,48 are independently rotatable. When the belts 38,40 are tensioned (see FIG. 3) the shafts 46,48 are rotated in unison, Alignment of the shafts 46,48 is assisted by a journal bearing 54. The journal bearing 54 includes a cylindrically shaped bearing 56 coaxially mounted on the end of the shaft 48, which supports a rod shaped journal 58 coaxially attached to the end of the shaft 46.

A hand-operated tensioning lever 60 is provided for the operator to move the tensioning pulley 50 from the tensioning position to the non-tensioning position, and vice versa. In the tensioning position of FIG. 3 the tensioning lever 60 is in a substantially horizontal position. In the non-tensioning position illustrated in FIG. 4 the tensioning lever 60 is in a substantially vertical position.

The shaft 52 is mounted on an arm 62. The arm 62 is rigidly mounted to rotatable shaft 64. The shaft 64 is rotatably mounted to the frame 12. The tensioning lever 60 is pivotally mounted to the frame 12 via a bearing assembly 66. The tensioning lever 60 is connected to the shaft 52 by a connecting rod 68. The connecting rod 68 is pivotally connected to the tensioning lever 60 via a slot 70 provided in a bracket 72, which is integrally connected to the tensioning lever 60.

Figure 2:
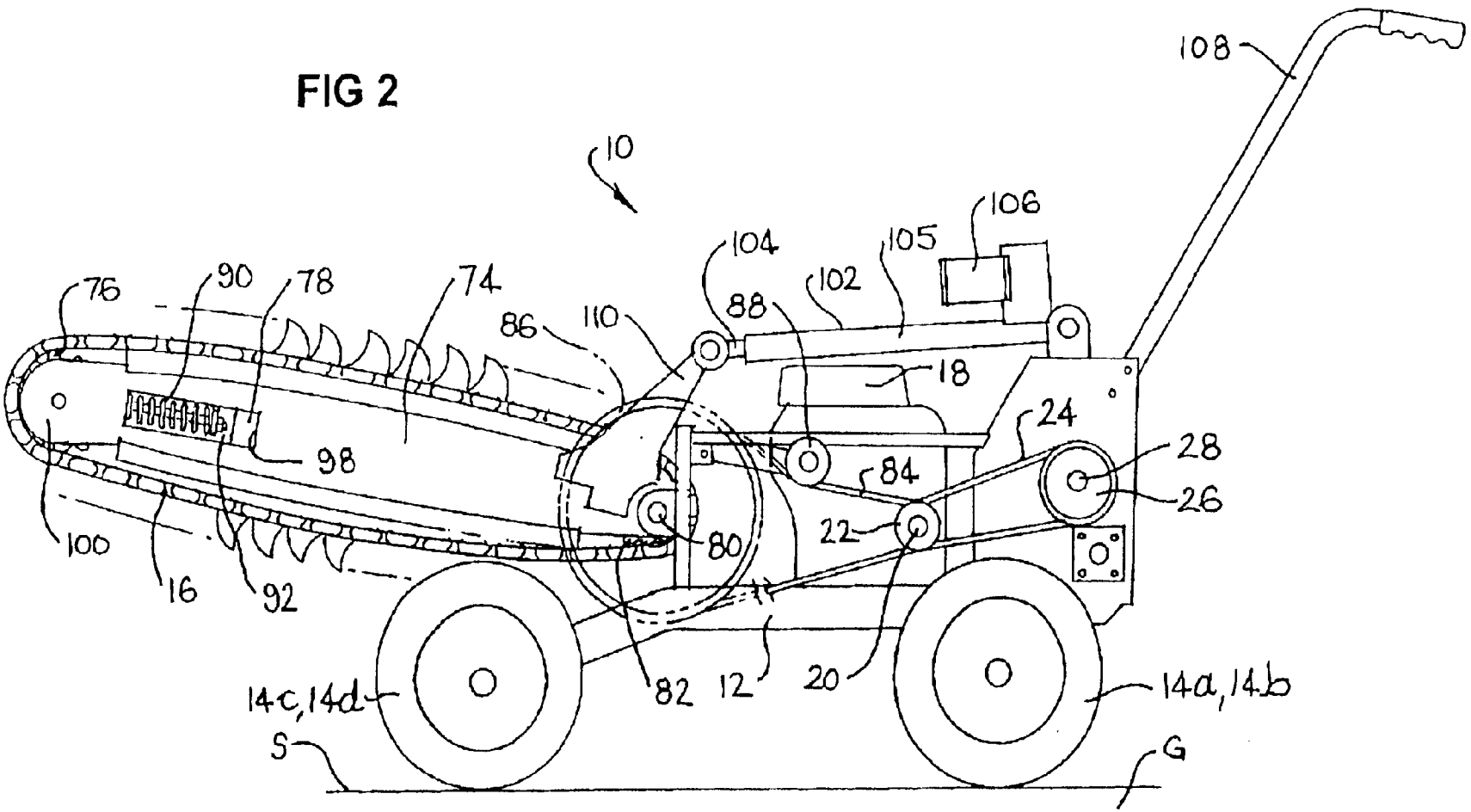
FIG. 2 is a side partial cross-sectional view of a trenching machine according to the present invention, with the digging chain in a non-digging (inactive) position.
Figure 6:
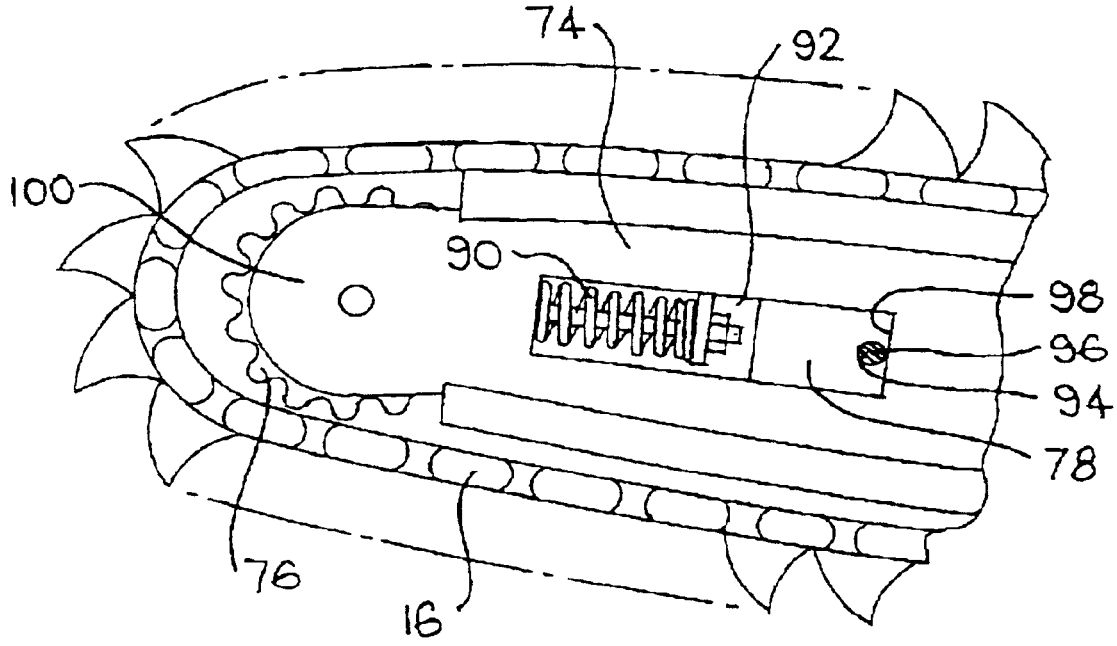
FIG. 6 is a side view of a portion of the digging chain and chain guide of the trenching machine of FIG. 1.

FIGS. 1, 2 and 6 illustrate a digging chain 16, which is carried on a chain guide 74. The chain guide 74 includes an end sprocket 76. The chain guide 74 is slidably mounted on a boom 78. The boom 78 is pivotally mounted to the frame 12 about a shaft 80. The boom 78 is coaxially pivotally mounted to the frame 12 with a chain drive sprocket 82.

The engine 18 drives the drive sprocket 82 via a belt 84 and drive pulley 86. The drive sprocket 82 and the drive pulley 86 are rigidly mounted on the shaft 80. A tensioning pulley 88 is provided to maintain tension in the belt 84.

Rotation of the drive sprocket 82 causes the digging chain 16 to rotate about the drive sprocket 82 and the chain guide 74.

When the machine 10 is operated, it is highly desirable that the digging chain 16 be sufficiently tensioned about the drive sprocket 82 and the chain guide 74 such that slippage of the digging chain does not occur. A biasing spring 90 is located in a socket 92 in the chain guide 74 and the boom 78 to bias the chain guide 74 away from the drive sprocket 82. Thus, the chain guide 74 is biased along the boom 78 away from the drive sprocket 82 to thereby maintain tension in the digging chain 16.

There are occasions where fitting and/or removal of the digging chain 16 from the machine 10 is required, such as for maintenance or repair. To this end, and as illustrated in FIG. 6, an aperture 94 is provided in the boom 78, through which a securing pin 96 is inserted. Insertion of the securing pin 96 into aperture 94 prevents the chain guide 74 from moving to the left along the boom 78 (when viewed from the angle illustrated in FIGS. 1,2 and 6) under the influence of the biasing spring 90. This is because an aperture edge 98 of the chain guide 74 contacts the securing pin 96 preventing the chain guide 74 from further movement to the left.

A mechanism in the form of levering arm (not illustrated) is pivotally connected to one of the chain guide 74 and the boom 78. To insert the securing pin 96, the levering arm is actuated by the operator. Actuation of the levering arm causes the chain guide 74 to move longitudinally relative to the boom 78 in a direction away from the machine 10 and against the biasing action of the biasing spring 90. This levering action is carried out until the securing pin 96 is fitted, at which point the digging chain 16 is sufficiently loosened for removal from and/or fitting to the machine 10.

Removal of the securing pin 96 enables the chain guide 74 to move to the left under the influence of the biasing spring 90, thereby tensioning the digging chain 16 for use.

As previously mentioned, the machine 10 illustrated in FIG. 1 is in a trench digging position. In this arrangement the distal end 100 of the chain guide 74 is located below the ground surface S. When the trenching operation has been completed the chain guide 74 is rotated to a position such as illustrated in FIG. 2, wherein the distal end 100 of the chain guide 74 and the digging chain 16 are clear of the ground surface S.

An actuating arm 102 is provided for altering the angle of the chain guide 74 relative to the frame 12. The actuating arm 102 is pivotally connected between the frame 12 and the boom 78 at pivot points 104, 106.

The actuating arm 102 includes a screw-threaded shaft 104, which is longitudinally movable relative to an actuating arm housing 105. The thread on the shaft 104 meshes with the thread of a rotatably mounted helical (or bevel) gear (not illustrated) mounted within the housing 105. The helical gear is rotated by an electric motor 106, which is powered by an electric battery (not illustrated). The electric motor 106 is mounted to the actuating arm housing 105. The shaft 104 is pivotally connected to the boom 78 by a connecting arm 110.

The machine 10 includes a handle 108 to enable the operator to direct the machine 10. An actuating arm switch (not illustrated) is mounted on the handle 108 to enable the operator to operate the actuating arm 102 to raise and lower the chain guide 74 as necessary. The actuating arm 102 also acts as a locking means to lock the chain guide 74 in a desired pivotal position once the operator has moved the chain guide 74 to the desired position.

When the operator is desirous of lowering the chain guide 74, the actuating arm switch is switched to a chain guide lowering position. This activates the electric motor 106 that, in turn, rotates the helical gear. The helical gear meshes with the thread of the screw threaded shaft 104. This causes the screw threaded shaft 104 to extend from the actuating arm housing 105, to thereby pivot the chain guide 74 downwardly into a ground engaging position.

It is to be appreciated that when the operator switches the actuating arm switch to a chain guide raising position, the screw threaded shaft 104 retracts into the housing 105, thereby pivoting the chain guide 74 upwardly.

In one form, the actuating arm 102 could include a LINAK LA 38 linear actuator, or similar.

It is to be appreciated that the trenching machine of the present invention is more manoeuvrable than existing trenching machines by including a means for releasably engaging the motor from the frame drive wheels.

It is also to be appreciated that providing a means for releasably securing the chain guide in a position relative to the chain drive sprocket, as in the present invention, enables the digging chain to be fitted and/or removed from the machine more easily when compared to existing arrangements.

Furthermore, it is to be appreciated that the means for pivotally moving the chain guide relative to the frame according to the present invention does not undesirably draw power from the motor driving the digging chain, such as occurs with existing trenching machines.

Other benefits of the new trenching machine will be readily apparent to persons skilled in the relevant art.

Finally, it is to be understood that various alterations, modifications and/or additions may be introduced into the constructions and arrangements of parts previously described without departing from the spirit or ambit of the invention.

What is claimed is:

1. A trenching machine comprising:

a wheeled frame, an engine mounted on the frame comprising a first motor means and a second motor means, wherein, the first motor means drives a digging chain carried on a chain guide extending from the machine, the chain guide being pivotally mounted coaxially with a drive chain drive sprocket, and wherein the second motor means drives at least one of the machine wheels for moving the machine along the ground, wherein the second motor means is releasably engaged to at least one of the machine wheels and drives at least two substantially coaxial frame wheels that are independently rotatable when disengaged from the second motor means, and rotated in unison when engaged with the second motor means, means for pivotally moving the chain guide relative to the frame, and, locking means to lock the chain guide in a desired pivotal position.

2. A trenching machine according to claim 1, including at least two at least substantially coaxial drive pulleys, and respective at least substantially coaxial driven pulleys, with a belt extending around each respective drive pulley and driven pulley combination.

3. A trenching machine according to claim 2, wherein the drive pulleys are connected to a common shaft, which is rotated by the second motor means, and the driven pulleys are connected to separately rotatable at least substantially coaxial shafts, which drive the respective at least two substantially coaxial frame wheels.

4. A trenching machine according to claim 2, wherein the belts are adjustably tensioned via at least one adjustable tension pulley actuable by a hand-operated lever.

5. A trenching machine according to claim 1, wherein the first motor means and the second motor means are the same motor means.

6. A trenching machine comprising:

a wheeled frame, an engine mounted on the frame comprising a first motor means and a second motor means, wherein, the first motor means drives a digging chain carried on a chain guide extending from the machine, the chain guide being pivotally mounted coaxially with a drive sprocket, and wherein the second motor means drives at least one of the machine wheels for moving the machine along the ground, wherein the chain guide is releasably securable in a position relative to the drive chain sprocket enabling fitting and removal of the digging chain from the machine, and further wherein the chain guide is longitudinally slidably mounted on a boom and such that at least one aperture is provided in each of the chain guide and boom in relative positions so the apertures are aligned for receiving a securing pin when the chain guide is moved longitudinally along the boom to a point where the digging chain is relatively loosely fitted about the drive sprocket and the chain guide to enable fitting and removal of the digging chain, means for pivotally moving the chain guide relative to the frame, and, locking means to lock the chain guide in a desired pivotal position.

7. A trenching machine according to claim 6, wherein the chain guide is slidable along the boom from a position where the digging chain is relatively taut about the drive sprocket and chain guide, to a position where the digging chain is relatively loosely fitted about the drive sprocket and chain guide.

8. A trenching machine according to claim 6, comprising a spring to bias the chain guide away from the drive sprocket to thereby tension the digging chain about the drive sprocket and chain guide.

9. A trenching machine according to claim 8, comprising a levering arm actuable by a machine operator for moving the chain guide along the boom against the bias of the spring, to enable the chain guide to be releasably secured to the boom in a position enabling fitting and removal of the digging chain.

10. A trenching machine according to claim 6, wherein the first motor means and the second motor means are the same motor means.

11. A trenching machine comprising:

a wheeled frame, an engine mounted on the frame comprising a first motor means and a second motor means, wherein, the first motor means drives a digging chain carried on a chain guide extending from the machine, the chain guide being pivotally mounted coaxially with a drive chain drive sprocket, and wherein the second motor means drives at least one of the machine wheels for moving the machine along the ground, wherein the means for pivotally moving the chain guide relative to the frame comprises an actuating arm, wherein the actuating arm comprises a longitudinally movable screw threaded shaft, which meshes with rotatably mounted helical or bevel gear, means for pivotally moving the chain guide relative to the frame, and, locking means to lock the chain guide in a desired pivotal position.

12. A trenching machine according to claim 11, wherein the actuating arm is pivotally connected between the frame and at least one of the chain guide and a boom upon which the chain guide is slidably mounted.

13. A trenching machine according to claim 11, wherein the actuating arm comprises at least one of: a hydraulic ram; and screw threaded shaft and mating trunnion.

14. A trenching machine according to claim 11, comprising a motor means for rotating the helical or bevel gear to longitudinally move the screw threaded shaft.

15. A trenching machine according to claim 14, wherein the motor means for rotating the helical or bevel gear is an electric motor mounted on the frame.

16. A trenching machine according to claim 11, wherein the first motor means and the second motor means are the same motor means.

17. A trenching machine according to claim 11, wherein the actuating arm is capable of pivotally moving the chain guide relative to the frame to at least three positons, wherein the first position provides the digging chain in a digging position, with the distal end of the chain digging the ground below ground level, the second position provides the chain guide in a digging commencement position, such that the digging chain rests upon the surface of the ground, and the third position provides the chain guide in a non-digging position, wherein the digging chain is clear of the ground surface.

* * * * *